US005456774A

United States Patent [19]

Moon et al.

[11] Patent Number: 5,456,774

[45] Date of Patent: Oct. 10, 1995

[54] THERMOMECHANICAL TREATMENT METHOD FOR PROVIDING SUPER-PLASTICITY TO AL-LI ALLOY

[75] Inventors: In Ge Moon; Jong Woo Park; Jae Eun Yoo, all of Seoul, Rep. of Korea

[73] Assignee: Korea Institute of Science and Technology, Seoul, Rep. of Korea

[21] Appl. No.: 233,019

[22] Filed: Apr. 25, 1994

Related U.S. Application Data

[63] Continuation of Ser. No. 980,987, Nov. 24, 1992, abandoned.

[30] Foreign Application Priority Data

Dec. 26, 1991 [KR] Rep. of Korea ..... 24401/1991

[51] Int. Cl.[6] ..... C22F 1/04

[52] U.S. Cl. ..... 148/691; 148/564; 148/692; 148/695; 148/696; 420/902

[58] Field of Search ..... 148/564, 691, 148/692, 695, 696, 439; 420/533, 543, 902

[56] References Cited

U.S. PATENT DOCUMENTS 4,582,544 4/1986 Grimes, et al. ..... 420/902

4,830,682 5/1989 Ashton et al. ..... 148/564

OTHER PUBLICATIONS

H. Yoshida, et al. J. Jpn. Inst. Light Met., vol. 39 (1989), pp. 817–823.

*Primary Examiner*—David A. Simmons
*Assistant Examiner*—Robert R. Koehler
*Attorney, Agent, or Firm*—Darby & Darby

[57] ABSTRACT

A thermo mechanical treatment method for providing super-plasticity to Al—Li alloy being a kind of light and high strength alloys. The thermo mechanical treatment method according the invention comprises steps of, homogenizing Al—Li alloy consisting of Al—Cu—Li—Mg—Zr at a temperature of 500°–500° C. for 10–30 hours, and controlled rolling the alloy at a temperature of 300°–500° C., a rolling speed of 2–20 m/min and a draft percentage per pass of 2–18%. The thermo mechanical treatment of the invention has a wide industrially applicable range and thus an excellent operation efficiency. The thermo mechanical treatment exhibits excellent super-plasticity at a higher strain speed as compared with known treatments.

5 Claims, 2 Drawing Sheets

THERMOMECHANICAL TREATMENT METHOD FOR PROVIDING SUPER-PLASTICITY TO AL-LI ALLOY

This is a continuation of application Ser. No. 07/980,987, filed Nov. 245, 1992, now abandoned.

BACKGROUND OF THE INVENTION

1. Field of the Invention

The present invention is related to a thermo mechanical treatment for providing super-plasticity to Al—Li alloy, and more particularly to a thermo mechanical treatment for providing super-plasticity to Al—Li alloy wherein Al—Li alloy is only subjected to a homogenization followed by a warm rolling without a solution treatment and an aging treatment.

2. Description of the Prior Art

As a thermo mechanical treatment method for providing super-plasticity to Al—Li alloy, a kind of light and high strength Al alloy that has become the center of public interest recently, there have been known four kinds of processes representatively, that is, an extruding process, RI-process, Sumitomo-1 and Sumitomo-2 processes. The above-mentioned processes will be described respectively hereinafter.

First, the extruding process is a method for providing super-plasticity to Al—Li alloy by controlling state of precipitation with response to compositions of alloys wherein an ingot is subjected to homogenization and then immediately extruded without intermediate steps. In the process, extrusion speed and extrusion temperature function as factors of super-plasticity.

While the extruding process has advantage in that the thermo mechanical treatment is simple, the process has disadvantage in that the resulting alloy shows a low plastic strain ratio of about 300%.

Secondly, the RI-process is a thermo mechanical treatment developed by Rockwell International Co., U.S.A. The RI-process has been originally developed with the intention of achieving fine grains of 7000 series Al alloy. A study which intended initially to apply the RI-process to Al—Li alloy is disclosed in "Al—Li Alloys II, Met. Soc. AIME, 111–135 (1983) by J. Wordsworth et al., wherein Al—3Cu—2Li—1Mg—0.15Zr alloy manufactured by Lockheed Co. is subjected to double stepped homogenization (first step: for 18 hours at a temperature of 460° C., second step: for 16 hours at a temperature of 500° C.) and then subjected to the RI-process, thereby achieving excellent plastic strain ratio of about 878%.

The heat treatment of the above RI-process comprises a series of steps, that is, a solution treatment, an overaging, a warm rolling and a recrystallization.

However, since the RI-process has been originally developed with the intention of providing super-plasticity to static recrystallization type of Al alloy, it is not suitable to dynamic recrystallization type of Al—Li alloy in super-plasticity and is complicated.

Thirdly, the Sumitomo-1 process modified from the RI-process by H. Yoshida et al. which is disclosed in "4th Int. Al—Li Conf., De Physique, 48, 289–275 (1987)" is carried out such that hot rolled alloy plate is not subjected to a solution treatment and an aging treatment at two steps separately but subjected to the two treatments at one step simultaneously, that is, the alloy plate is annealed at a temperature of 380°–48° C. and cooled in a furnace to allow second phases to be precipitated, and then cold rolled into a strain ratio of 80–90% and recrystallized to achieve fine crystal grains, thereby providing super-plasticity to the alloy plate.

However, although the Sumitomo-1 process has been also developed with the intention of achieving fine crystal grains of 7000 series A1 alloy, it is difficult to provide desirable super-plasticity to Al—Li alloy.

Finally, the Sumitomo-2 process which is modified from the Sumitomo-1 process by H. Yoshida et al. is disclosed in" J. Jpn. Inst. Light Met., V. 39, 817–823 (1989)". In the process, dynamic recrystallization type of Al—Li alloy is subjected to a homogenization and then a controlled rolling to achieve fine crystal grains at the time of a high temperature tension. That is, a 8090 Al—Li alloy ingot is homogenized at a temperature of 520° C. for 24 hours and then rolled under optimal condition of a rolling speed of 3–30 m/min, a temperature of 300° C. and a reduction ratio of 5–15%. The Sumitomo-2 process has advantage in that its thermo mechanical treatment is simple and its super-plasticity is superior to prior art.

However, super-plasticity achieved by the Sumitomo-2 process is considerably reduced under condition beyond the optimal rolling condition. Also, since the rolling condition of the Sumitomo-2 process is not suitable to other Al—Li alloys except for the 8090 Al—Li alloy, its application is limited in a small range.

The reason why the above problems occur in the Sumitomo-2 process is that state of precipitations affecting growth of sub-grains being of importance in super-plastic alloy made by the dynamic recrystallization method varies depending upon the composition of alloy.

For example, in order to achieve excellent super-plasticity, it is preferable to precipitate $T_1(Al_2CuLi)$ phases effective in growth and maintenance of fine sub-grains in case of 2090 Al—Li alloy while it is preferable to precipitate $T_2(Al_6Li_3Cu)$ phases in case of 8090 Al—Li alloy.

There has been published results of research showing that when the 2090 and 8090 Al—Li alloy ingots were homogenized and then extruded at various extrusion temperatures and speeds based on the Sumitomo-2 process, the 2090 Al—Li alloy showed an optimal condition of 400° C. and 0.75/min and the 8090 Al—Li alloy showed an optimal condition of 300° C. and 1.5/min. Accordingly, it was found that optimal condition in the Sumitomo-2 process varies depending upon the compositions of Al—Li alloy from the results of research.

SUMMARY OF THE INVENTION

Accordingly, the present invention has been made to overcome the above-described problems and to reserve the above advantages obtained in the prior art and an object of the invention is to provide a thermo mechanical treatment for providing super-plasticity to Al—Li alloy which is capable of providing super-plasticity to Al—Li alloy by its simple thermo mechanical treatment and also providing industrially applicable super-plasticity to Al—Li alloy even under condition beyond optimal condition for thermo mechanical treatment.

Alloy becoming an object of thermo mechanical treatment according to the present invention is Al—Cu—Li—Mg—Zr alloy which shows the highest strength in Al—Li alloys and is consisting of Cu 2–3.3%, Li 1.9–3.3%, Mg 0.2–1.2%, Zr 0.08–0.16% and the balance of Al.

The Al—Li alloy becoming an object of thermo mechanical treatment according to the invention is one kind of alloys developed by the Lockheed Co., U.S.A, 1980 as super-plastic material and contains lower LI and higher Cu as compared with the 8090 Al—Li alloy.

Since the composition range of the alloy includes composition range of the 2090 Al—Li alloy and has higher Cu content than Li content, it is preferable to precipitate $T_1$ phase rather than $T_2$ phase. Therefore, as mentioned above, it will be appreciated that it is preferable from the view-point of super-plasticity to roll at a temperature of 400° C. suitable to precipitate $T_1$ phase rather than at a temperature of 300° C., as similar to the 8090 Al—Li alloy.

Although the present inventors applied the thermo mechanical treatment of the RI-treatment to the object alloy 18 of the invention, the treatment was not capable of providing desirable super-plasticity. However, when the treatment was applied to the dynamic recrystallization method wherein alloy material is subjected to a rolling and then immediately subjected to a high temperature tension without a recrystallization treatment, it was capable of achieving super-plasticity superior to that achieved by the prior static recrystallization method.

However, the RI-process modified in its some steps was ascertained not to be applicable industrially in practice because its thermo mechanical treatment is complicate and requires a long time.

Therefore, the inventors developed a thermo mechanical treatment on the basis of the Sumitomo-2 process that is one of thermo mechanical treatment methods being most suitable to the 8090 Al—Li alloy in known thermo mechanical treatment methods for Al—Li alloy. The thermo mechanical treatment of the invention is appropriately applicable to the object alloy of the invention and is superior to all the known thermo mechanical treatments in super-plasticity.

That is, the thermo mechanical treatment of the invention is characterized in that a homogenization is carried out at a temperature range of 500°–550° C. without a solution treatment and an aging treatment to achieve solid solution of phases in a matrix and then a warm rolling is carried out at about 400° C. to precipitate uniformly $T_1$ phases suppressing growth of sub-grains.

BRIEF DESCRIPTION OF THE DRAWINGS

These and other objects, features and advantages of the invention will become more apparent upon a reading of the following detailed specification and drawings, in which.

DETAILED DESCRIPTION OF THE PREFERRED EMBODIMENTS

Figure 1:
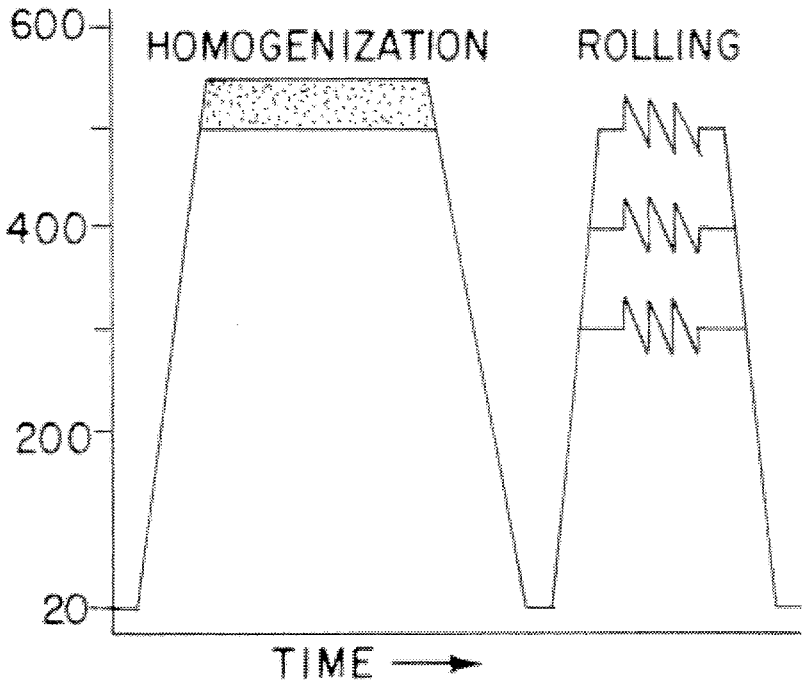
FIG. 1 is a graph showing a thermo mechanical treatment process according to the present invention.

A process of thermo mechanical treatment according to the present invention will now be described by referring to the accompanying drawings. Referring to FIG. 1, there is shown a time-temperature graph showing process of the thermo mechanical treatment of the invention.

First, Al—Li ingots prepared by vacuum melting are homogenized at a temperature range of 500°–550° C. for 10–30 hours so that large-size phases (for example, compound such as Al—Cu, Al—Cu—Li, Al—Cu—Fe phases) are sufficiently redissolved in a matrix, thereby preventing occurrence of cracking at the time of subsequent warm rolling procedure. In addition, Cu that is necessary to precipitate $T_1$ phase suppressing growth of sub-grains is more largely supplied during a subsequent warm rolling step in order to maintain stably fine sub-grains at the time of high temperature tension.

After the homogenization has been completed, the resulting test materials are scalped by thickness of about 2 mm. Then, the test materials are charged into an electric furnace elevated to temperatures of 300° C., 400° C. and 500° C., respectively and held for 30–120 minutes depending upon their sizes. Thereafter, the test materials are rolled into a total strain ratio of 93% at a draft percentage per pass of 2–18% and a rolling speed of 2–20 m/min. At this time, there is provided with reheating time of 3–5 minutes between the passes.

In result, the present inventors found that an optimal rolling temperature for super-plasticity of Al—Li alloy is a temperature of 400° C., as anticipated above.

In the above rolling step, the rolling process is controlled by varying factors such as a rolling speed, a draft percentage, a rolling temperature and holding time before rolling so that grain boundaries in the cast materials are substantially removed to form stable base structure of sub-grains including evenly distributed fine grains. The fine grains function as recrystallization nuclei causing fine grains to be formed during deformation, thereby achieving excellent super-plasticity.

As mentioned above, since the thermo mechanical treatment method for Al—Li alloy according to the invention omits a solution treatment and an aging treatment and abbreviates a homogenization treatment to one step, it is possible to simplify its process. Since the homogenization treatment is carried out at a high temperature, the treatment time is considerably reduced. Also, since the stable base structure of sub-grains is formed by a re-solution of phases containing Cu, fine recrystallized grains can be achieved.

Structural and super-plastic properties of Al—Li alloy treated by the thermo mechanical treatment process of the invention will be now described based on the basis of specific test results.

In order to observe structure of Al—Li alloy treated by the thermo mechanical treatment of the invention, a test material was held at a temperature of 530° C. for 10 minutes after a warm rolling and then water cooled. In result, a uniform and fine sub-grain structure having a size of 0.5–μm was achieved.

Although sub-grain size of Al—Li alloy treated by known thermo mechanical treatments may slightly vary depending upon the compositions of alloy and condition of thermo mechanical. treatment, it is substantially of 2–3 μm. Therefore, it will be appreciated that the sub-grains achieved by the thermo mechanical treatment of the invention has fine size as compared with those by known thermo mechanical treatments.

Figure 2:
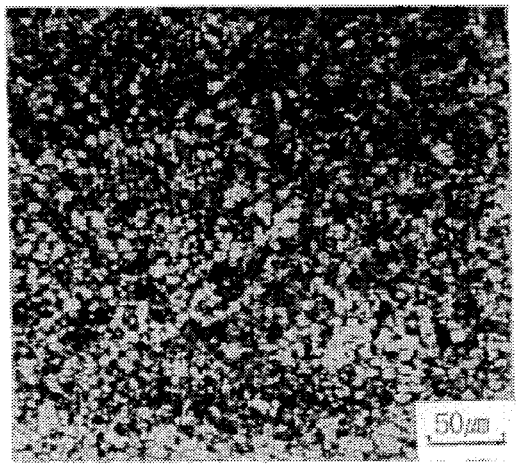
FIG. 2 is a microscopic photograph of grains which are subjected to a thermo mechanical treatment of the invention and subjected a high temperature tension to be fine.

Referring to FIG. 2, there is shown a microscopic photograph of Al—Li alloy structure which is treated by the thermo mechanical treatment of the invention and subjected to a high temperature tension at a temperature of 530° C an a tension speed of $2\times10^{-2}$/sec. The photograph shows a recrystallized structure having grains of 6–7 μm. Particularly, grains which had undergone growth of grain show a size of 12– 15 μm. However, Al—Li alloy treated by known thermo mechanical treatments has fine grains of a size of 10–15 μm after dynamic recrystallization and has grains of a size of 20–25 μm after growth of grain. Accordingly, it will be appreciated that A—Li alloy treated by the thermo mechanical treatment of the invention has finer grains as compared with that treated by the known thermo mechanical treatment.

As mentioned above, since Al—Li alloy treated by the thermo mechanical treatment of the invention has fine sub-grains and recrystallized grains and has a small degree of growth of grains, super-plasticity of the Al—Li alloy is improved. This can be ascertained by the following testing results.

A high temperature tension for super-plasticity was carried out at a temperature of 450°–545° C. and in initial strain speed range of $10^{-3}$–$10^{-4}$/sec. In result, an optimal condition for super-plasticity varied in response to respective rolling temperatures, that is, after a high temperature tension was carried out at a temperature of 530° C., an elongation of 900–1200% was achieved at a strain speed of $10^{-2}$/sec in case of a rolling temperature of 300° C., an elongation of 1000–1200 % was achieved at a strain speed of $2.1\times10^{-2}$/sec in case of a rolling temperature of 400° C. and an elongation of 700–800% was achieved at a strain speed of $10^{-2}$/sec in case of a rolling temperature of From this results, it is noted that the maximum values of strain speed and elongation are achieved at a temperature of 400° C. suitable to precipitate $T_1$ phases, as noted previously. Also, it is appreciated that industrially applicable range of thermo mechanical treatment for super-plasticity becomes wide.

Figure 3:
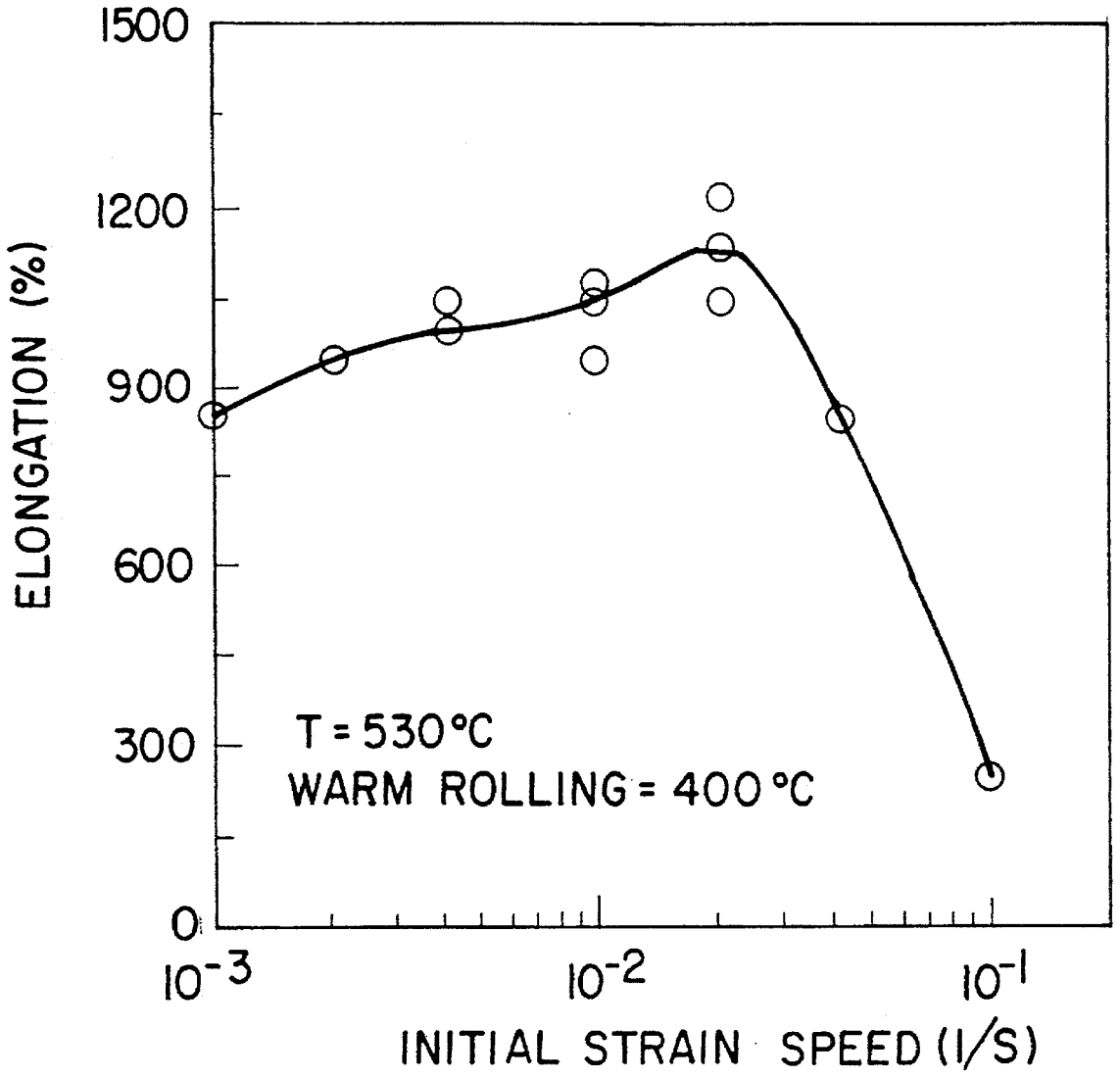
FIG. 3 is an elongation-strain speed graph of alloys which are subjected to a thermo mechanical treatment of the invention and a high temperature tension.

Referring to FIG. 3, there is shown an initial strain speed-elongation graph of alloy plate which is rolled at the optimal rolling temperature of 400° C. and subjected to high temperature tension. As shown in the graph, when the high temperature tension was carried out at a temperature of 530° C. in initial strain speed range of $10^{-3}$–$10^{-1}$/sec, the maximum elongation of 1200% was achieved at a strain speed of $2.1\times10^{-2}$.

When this result is compared with result that elongation of 800–1000% is achieved at strain speed of $\mathbf{10}^{-4}$–$10^{3}$/sec by known thermo mechanical treatment, the invention exhibits excellent super-plasticity at a strain speed which is higher about 20–100 times than that of prior art.

In particular, when the thermo mechanical treatment of the invention is compared with the known Sumitomo-2 process wherein elongation of 1100% is achieved at a strain speed of $5\times10^{-3}$/sec for the 8090 Al—Li alloy, the invention exhibits excellent super-plasticity at a strain speed which is higher about 4 times than that of the Sumitomo-2 process.

As apparent from the above description, while it is required several ten minutes to several hours to complete manufacture of one product by known thermo mechanical treatments when a strain speed is relatively low, time required to complete manufacture of one product by the invention is reduced within ten and several minutes, thereby improving productivity.

Also, the thermo mechanical treatment for super-plasticity according to the invention exhibits an elongation of about 800% even at a strain speed of $4.2\times10^{-2}$/sec that is higher two times than the optimal strain speed. Since this elongation is a value that is far higher than a practically used elongation of 300%, the invention can complete manufacture of one product within several minutes when the elongation of 300% is applied.

Therefore, the thermo mechanical treatment for super-plastication of Al—Li alloy according to the invention is simple as compared with all known thermo mechanical treatments and also has wide industrially applicable range of thermo mechanical treatment.

For a better understanding of the present invention, some specific examples are given hereinbelow by way of illustration of its particular embodiments.

EXAMPLE 1

Al—Li alloy ingots prepared by a vacuum melting process were consisting of Cu 2.95%, Li 2.04%, Mg 1% , Zr 0.14 and the balance of Al, respectively. The ingots were homogenized at 535° C. for 24 hours and scalped by 2 mm. The resulting test materials were charged into electric furnaces elevated to 300° C., 400° C. and 50° C. respectively and held therein for 60minutes. Thereafter, the test materials were rolled at a draft percentage of 3–18% per pass and a rolling speed of 2–7 m/min so that the materials were deformed from an initial thickness of 28 mm to a final thickness of 2 mm, that is, into a total strain ratio of 93%. Holding times for reheating between passes were about 5minutes.

After a high temperature tension at 530° C. and a strain speed of $10^{-3}$–$10^{-1}$/sec, an elongation of 1000–1200% was achieved at a strain speed of $10^{-2}$/sec in case of the rolling temperature of 300° C., an elongation of 1000–1200% was achieved at a strain speed of $2.1\times10^{-2}$/sec in case of the rolling temperature of 400° C. and an elongation of 700–800% was achieved at a strain speed of $10^{-2}$/sec in case of the rolling temperature of 500° C.

EXAMPLE 2

Al—Li alloy ingots prepared by a vacuum melting process were consisting of Cu 2.4%, Li 2%, Mg 1.2% , Zr 0.08 and the balance of Al, respectively. The ingots were homogenized at 500° C. for 30 hours and scalped by 2 mm. The resulting test materials were charged into electric furnaces elevated to 300° C., 400° C. and 500° C. respectively and held therein for 60 minutes depending upon the sizes of the test materials. Thereafter, the test materials were rolled at a draft percentage of 2–15% per pass and a rolling speed of 2–20 m/min so that the materials were deformed into a total strain ratio of 93%. Holding times for reheating between passes were 3–5 minutes.

After a high temperature tension at 530° C. and strain speed of $10^{-3}$–10–1/sec, an elongation of 900–1000% was achieved at a strain speed of $10^{-2}$/sec in case of the rolling temperature of 300° C., an elongation of 1000–1200% was achieved at a strain speed of $2.1\times10^{-2}$/sec in case of the rolling temperature of 400° C. and an elongation of about 700% was achieved at a strain speed of $10^{-2}$/sec in case of the rolling temperature of 500° C.

EXAMPLE 3

Al—Li alloy ingots prepared by a vacuum melting process were consisting of Cu 2.71%, Li 2.3%, Mg 0.2% , Zr 0.1 and the balance of Al respectively. The ingots were homogenized at 540° C. for 20 hours and scalped by 2mm. The resulting test materials were charged into electric furnaces elevated to 300° C., 400° C. and 500° C. respectively and held therein for 60minutes. Thereafter, the test materials were rolled at a draft percentage of 5–15% per pass and a rolling speed of 3– 7 m/min so that the materials were deformed from an initial thickness of 28 mm to a final thickness of 2 mm, that is, into a total strain ratio of 93%. Holding times for reheating between passes were about 3 minutes.

After a high temperature tension at 530° C. and a strain speed of $10^{-3}$–$10^{-1}$/sec, an elongation of 1000–1200% was achieved at a strain speed of $10^{-2}$/sec in case of the rolling temperature of 300° C., an elongation of 1000% was achieved at a strain speed of $2.1\times10^{-2}$/sec in case of the rolling temperature of 400° C. and an elongation of 800–950% was achieved at a strain speed of $10^{-2}$/sec in case of the rolling temperature of 500° C.

Although the examples of the invention have been disclosed for illustrative purposes, those skilled in the art will appreciate that various modifications, additions and substitutions are possible, without departing from the scope and spirit of the invention as disclosed in the accompanying claims.

What is claimed is:

1. A process for super-plasticization of alloys, which consists essentially of the steps of:

(a) homogenizing an Al—Li alloy consisting of 2–3.3% Cu, 1.9–3.3% Li, 0.2–1.2% Mg, 0.08–0.16% Zr, and the balance of Al, at about 500°–550° C. for about 10–30 hours; and (b) warm rolling said alloy at about 300°–500° C., wherein said warm rolling step takes place without a prior solution treatment and prior aging treatment.

2. A process according co claim 1, wherein said warm rolling step (b) is carried out at a rolling speed of 2–20 m/min and a draft per pass of 2–18%.

3. A process according to claim 1, wherein said warm rolling step (b) is carried out at about 400° C.

4. A process according to claim 3, further comprising subjecting said alloy to tension at about 530° C., wherein said alloy is elongated at a strain speed of $2.1\times10_{-2}$/sec.

5. A process for super-plasticization of Al—Li alloy, which consists essentially of the steps of:

(a) homogenizing said alloy, which consists of 2–3.3% Cu, 1.9–3.3% Li, 0.2–1.2% Mg, 0.08–0.16% Zr, and the balance of Al, at about 500°–550° C. for 10–30 hours;

(b) warm rolling the homogenized alloy at about 400° C., at a rolling speed of 2–20 m/min and a draft percentage per pass of 2–18%, wherein said warm rolling step takes place without a prior solution treatment and a prior aging treatment; and (c) subjecting said warm rolled alloy to tension at about 530° C. at a strain speed of $2.1\times10^{-2}$/sec.

* * * * *